US005762060A

United States Patent [19]

Larson

[11] Patent Number: 5,762,060

[45] Date of Patent: Jun. 9, 1998

[54] HANDLE RISER FOR ARCHERY BOWS

[75] Inventor: Marlow W. Larson, Ogden, Utah

[73] Assignee: Browning, Morgan, Utah

[21] Appl. No.: 332,920

[22] Filed: Oct. 31, 1994

[51] Int. Cl.[6] ..... F41B 5/00

[52] U.S. Cl. ..... 124/88; 124/23.1

[58] Field of Search ..... 124/23.1, 24.1, 124/25.6, 44.5, 86, 88, 89

[56] References Cited

U.S. PATENT DOCUMENTS

| | | | |
|---|---|---|---|
| 2,344,799 | 3/1944 | Brown et al. | 124/88 X |
| 3,342,172 | 9/1967 | Sanders | 124/89 X |
| 3,695,248 | 10/1972 | Izuta | 124/89 X |
| 3,804,072 | 4/1974 | Izuta | 124/89 |
| 4,879,988 | 11/1989 | Larson | 124/88 X |
| 4,881,514 | 11/1989 | Denslow et al. | 124/23.1 X |
| 5,005,554 | 4/1991 | Shepley et al. | 124/24.1 |
| 5,119,796 | 6/1992 | Dehlbom | 124/23.1 |
| 5,161,514 | 11/1992 | Cary | 124/24.1 |
| 5,335,644 | 8/1994 | Smith et al. | 124/23.1 |

*Primary Examiner*—John A. Ricci
*Attorney, Agent, or Firm*—Foster & Foster

[57] ABSTRACT

A handle riser for an archery bow includes a vertical planar surface displaced from the vertical central axis of the riser to provide clearance for the fletching of an arrow launched from an overdraw support device mounted to the riser. A shock absorber may be mounted internal the riser. An accessory mount may be provided beneath the grip portion of the riser. A cable guard rod may be mounted to extend rearwardly parallel to and at the same elevation as the horizontal central axis of the riser.

18 Claims, 4 Drawing Sheets

HANDLE RISER FOR ARCHERY BOWS

BACKGROUND

Field: This invention pertains to archery bows. It is directed to handle risers for such bows, and provides improvements which are particularly significant to the risers of compound archery bows, but which are applicable to archery bow risers generally.

State of the Art: Archery bow handle risers are provided in a variety of configurations. Nevertheless, they all serve generally the same fundamental functions. Specifically, they provide support for the butt end of opposing bow limbs, as well as a grip for the archer. It is conventional practice to structure a bow such that at least the ends of its handle riser and its limbs are centered on a line. This line constitutes the vertical center line of the bow when it is held in normal arrow launching position. The grip is generally located at approximately the middle of the handle riser. The end portions of the riser between the grip and any limb-mounting structures carried by the opposite tips of the riser are strong and rigid. They thus provide convenient support for functional components of the cable riggings associated with certain compound bow constructions and for a variety of accessories, notably quivers, sights, stabilizers, arrow rests and overdraw devices. Handle risers are generally structured specifically for either right hand or left hand operation. They thus have distinguishable upper and lower ends.

A portion of the handle riser immediately above the grip is commonly shaped as a "sight window" to permit the shaft of an arrow to occupy the space intersected by the vertical center line of the riser. The sight window is considered to be that portion of the handle riser which is displaced laterally from the center line to accommodate the shaft of an arrow mounted for launching. The "sight window face" is the surface of the sight window nearest the arrow. Inadequate displacement of the sight window face on early handle riser designs has made overdraw shooting awkward.

Among the more commonly used accessories are quivers, sights and arrow rests. These accessories are conventionally mounted to a region above and spaced from the grip. This mounting region is often referred to as the "accessory face," and is traditionally located on the outer surface (opposite the sight window face) of the structure defining the sight window. In certain designs, a portion of the sight window immediately above the grip has been even further displaced from the centerline to accommodate overdraw structures. This portion of the sight window is referred to as an overdraw offset, and is defined by an approximately horizontal offset base, an upstanding offset panel and an approximately horizontal offset return. In such constructions, the accessory face is directly above the offset return. A recent example of such a structure is disclosed by U.S. Pat. No. 5,005,554, the disclosure of which is incorporated by reference.

An overdraw structure permits broadheads and fletchings to pass the handle riser without interference. With an overdraw offset present, however, the sight window becomes irregular in shape. Some archers find this configuration distracting, limiting the practical useful sight window to its most extreme offset portion. As a practical matter, the accessory face is restricted to the portion of the sight window located above the overdraw off set, although the overdraw device itself may serve as a mounting support for arrow rests and certain other accessories.

Accessories and other fixtures intended for mounting to handle risers are provided by various manufacturers other than those who furnish particular risers. As a consequence, there has evolved a standardized pattern of accessory mounting locations sanctioned by the Archery Manufacturer's Association (AMO). Those locations are conventionally occupied by accessory holes, and those holes are generally filled with standard threaded inserts. The inserts typically receive threaded fasteners carried by the accessories intended for mounting at a particular location. Both the fasteners and the inserts may be arranged in a standard pattern if more than one connection point is required for secure mounting of the accessory to the riser.

Certain mounting locations are often designated by reference to the accessory originally or most commonly mounted at that position on the handle riser. For example, handle risers are generally expected to be furnished with "cable guard," "stabilizer," "quiver" and "sight" mounting inserts, although other accessories may be mounted to these same insert locations.

Cable guards have been mounted at various locations along the handle riser. Their principal purpose is to hold the end stretch cables of a compound bow to one side of the vertical center line of the handle riser sufficiently to provide access by an archer's hand to the grip. In some instances, cable guards have been provided both above and below the grip. Most commonly, a single cable guard is installed below the grip, and a cable guard bushing insert is conventionally provided at a standard location in the lower end of the handle riser to receive the butt end of a cable guard rod. This positioning causes uneven torque forces to be applied to the upper and lower limbs. A stabilizer bushing may be positioned directly opposite the cable guard bushing. A stabilizer device may thus be mounted to extend forward from the riser, opposite the rearward extension of the cable guard.

The handle risers of many compound bows share important characteristics with the handle risers of take down "stick" (single run bow string) bows. In each case, the butt end of the individual bow limbs must be connected through a joint structure to opposite ends of the riser. Typical such joint structures are illustrated by U.S. Pat. No. 4,494,521; 4,574,766 and 4,674,468, for example.

SUMMARY OF THE INVENTION

This invention provides a handle riser structure that incorporates at least one of several improvements, any of which offers significant benefits to an archer, and the combination of which constitutes a comprehensive advance in handle riser design. The riser itself is ideally manufactured by Computer Numerical Control (CNC) techniques, and is configured to avoid the limitations imposed by the sight windows currently in favor. The sight window of the handle riser of this invention is defined by a vertical member which is offset from the centerline of the riser. The sight window face is approximately planar and vertical. It is displaced from the centerline sufficiently to accommodate an overdraw device, but extends to above the conventional location of the accessory face. In this fashion, the effective sight window is significantly enlarged in its vertical dimension. Preferably, the accessory face is approximately coplanar with the outer surface of the entire sight window structure.

A handle riser of this invention is typically used with archery bows of the type which include means for mounting an overdraw arrow support device. The handle riser thus typically includes a sight window, including a sight face, above a grip portion and displaced from a vertical central axis of the handle riser. The handle riser generally further includes an accessory mounting face spaced from and above the grip portion. The sight face is advantageously provided in the form of an approximately vertical planar surface spaced sufficiently from the central axis to provide clearance for the vanes of an arrow launched from an overdraw support device mounted to the handle riser. The sight face should extend from approximately the grip portion to approximately adjacent the accessory mounting face. Ideally, the handle riser further includes a stabilizer device mounted internal the handle riser.

Preferred embodiments of the handle riser of this invention include a cable guard extending from approximately the elevation of the vertical center axis of the riser, and includes an arm projecting rearward approximately parallel that axis. So located, the cable guard functions to balance the torque loads distributed to the upper and lower limbs of the bow during operation. The guard may be integral with the riser, or it may be a separate device connectable to the riser by mounting structure. In any event, the cable guard provides space in the grip region of the riser for an archer's hand.

Other preferred embodiments of the riser incorporate a shock stabilizer device, such as a mercury stabilizer, gyroscopic stabilizer or pendulum, directly within the riser.

According to this invention, an additional accessory mounting location may be provided at a lower region of the handle riser. So located, this "lower inset hole" is adapted to carry accessories in a rear position to balance the weight of other accessory structures, notably a forward-projecting stabilizer. The lower insert hole is an idea mounting location for a mercury filled rear stabilizer, for example. The balancing provided in this fashion is particularly advantageous in tournament situations in which leveling devices are not permitted.

The handle risers of this invention preferably include a special joint structure mounting the butts of opposing limbs to respective opposite ends of the riser. Notable features of this joint structure include limb bolt assemblies of special design, rocker bearings structured to resist twisting of the limbs and limb bolt bushings structured to positively secure the limb and to assist in adjusting the effective weight of the limbs.

The preferred limb joints of this invention may be adapted for use with either compound or take down recurve bows. They include an adjustment bolt with a locking jam nut for tightening after the adjustment bolt is operated to adjust the effective weight of the limbs. The jamb nut resists further turning of the adjustment bolt. A set screw may be positioned to jamb against the end of the adjustment bolt, thereby functioning as a jamb screw. The limbs are desirably mounted on hemispherical rocker bearings to resist twisting.

BRIEF DESCRIPTION OF THE DRAWINGS

In the drawings, which illustrate what is currently regarded as the best mode for carrying out the invention.

DESCRIPTION OF THE ILLUSTRATED EMBODIMENTS

Figure 1:
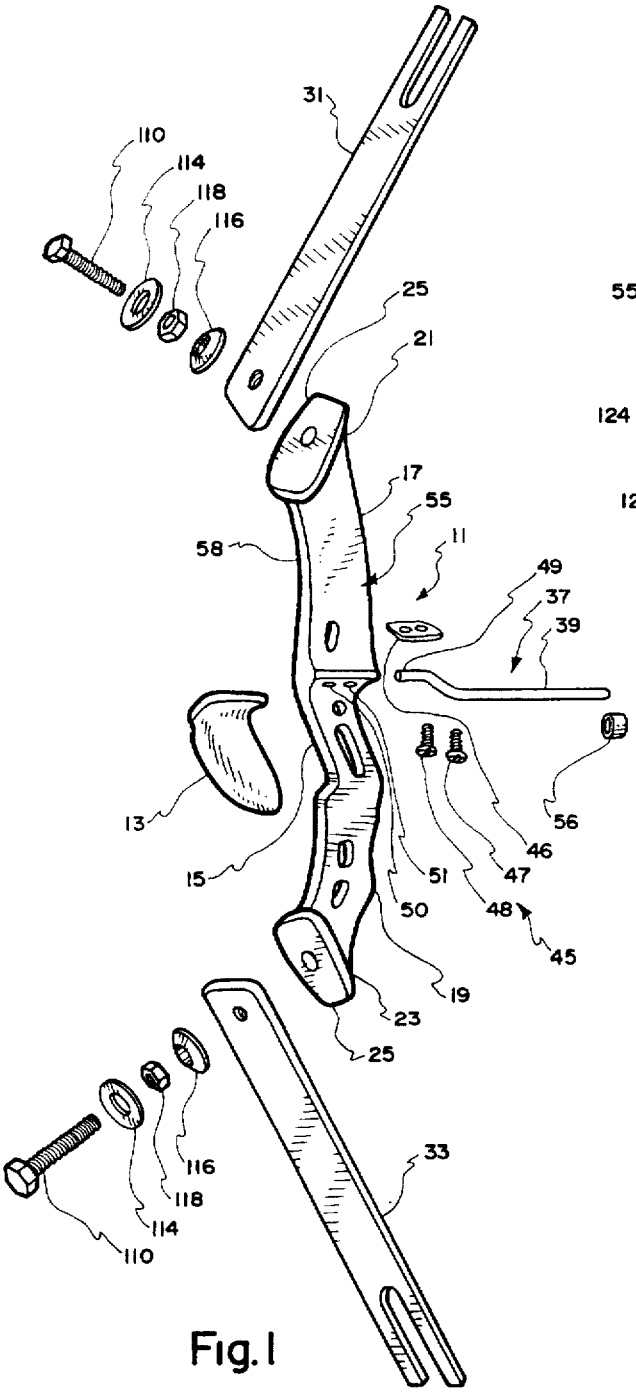
FIG. 1 is an exploded pictorial view of a handle riser of this invention, together with optional improvements.

Referring to FIG. 1, a handle riser 11 of this invention includes a removable grip 13 which is mountable to a handle portion 15 of the riser between an upper riser end 17 and a lower riser end 19, just below the horizontal central axis C—C of the bow. The respective end tips, 21, 23, carry mounting surfaces 25 (see FIG. 5), which comprise a joint, designated generally 27, for attaching the upper 31 and lower 33 limbs, respectively.

A cable guard, designated generally 37, is shown mounted at approximately the middle of the riser 11 so that its arm 39 extends approximately parallel and at the same elevation as the axis C—C. The arm 39 thus occupies a nontraditional location, but offers the advantage of precisely balancing the forces applied through the end stretch cables 41, 43 to the limbs 31, 33. A mounting fixture 45 is provided directly above the handle portion 15. the fixture 45 illustrated includes a mounting shelf 46 and threaded fasteners 47,48 which secure the shelf 46 and the butt end 49 of the cable guard rod 37 as shown by being turned in to threaded inserts 50, 51 just beneath the sight window 55. A cable-retaining fixture 56 may be mounted to slide along the arm 39 in conventional fashion. A sight assembly, not shown, may be mounted to an accessory mounting face 58, as may other traditional accessories.

Figure 4:
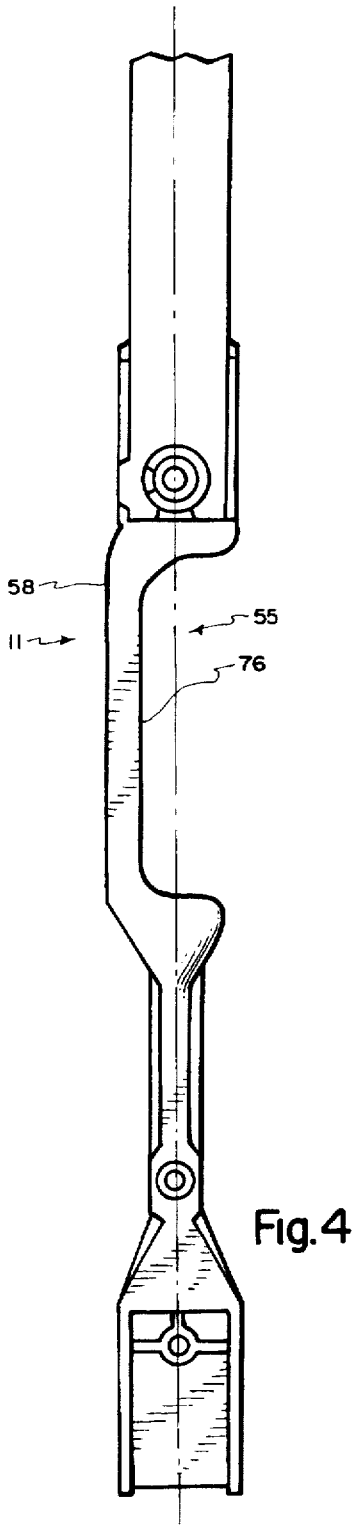
FIG. 4 is a fragmentary pictorial illustration similar to FIGS. 2 and 3, showing the handle riser of the invention.
Figure 2:
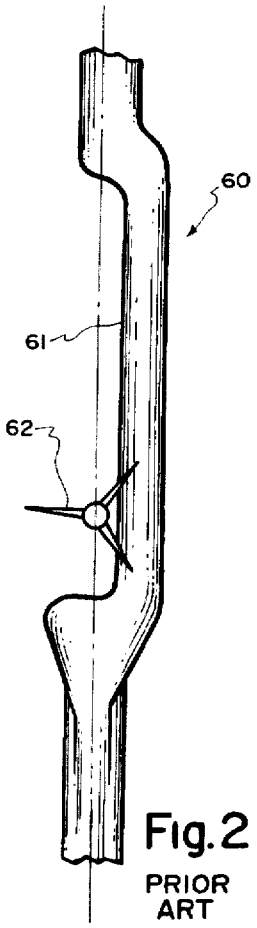
Fig. 2 PRIOR ART
FIG. 2 is a fragmentary pictorial illustration of a prior art handle riser construction.
Figure 3:
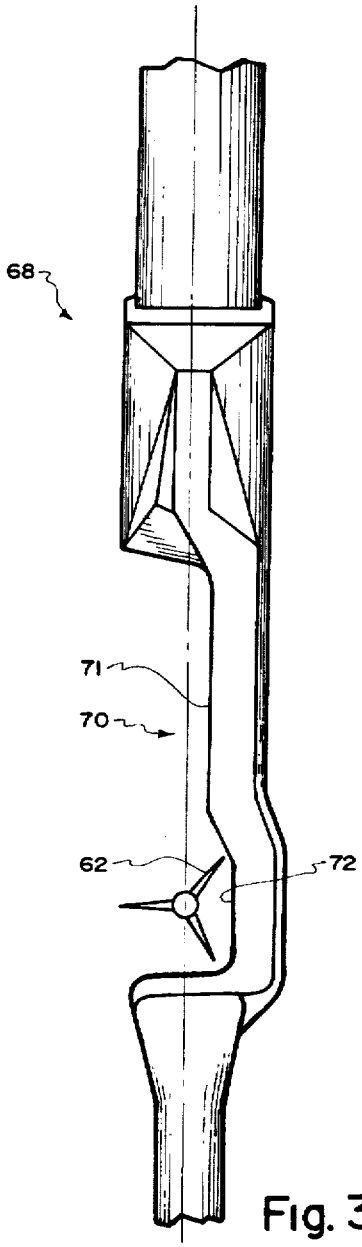
Fig. 3 PRIOR ART
FIG. 3 is a fragmentary pictorial illustration of an alternative prior art handle riser construction.

A comparison of FIGS. 2, 3 and 4 reveals a significant difference between the sight window 55 preferred for handle risers of this invention and the sight windows characteristic of prior art handle risers (FIGS. 2 and 3). Corresponding center reference lines R—R are displayed by each of those figures. FIG. 2 illustrates a typical early type of prior art handle riser 60 having a sight window face 61 displaced from the center line R—R a distance insufficient to pass an arrow fletching 62 without interference. FIG. 3 illustrates a more recent prior art handle riser 68 having a sight window face, generally 70, consisting of an upper portion 71, displaced to approximately the same extent as is the face 61 of the FIG. 2 handle riser, and a lower portion 72 displaced to a greater extent. The face 72 is displaced from the center line R—R sufficiently to pass the arrow fletching 62 without interference. By contrast, the handle riser 11 of this invention, as illustrated by FIG. 4, has a window face 76 displaced from the center line R—R to at least the extent that the lower portion 72 of the sight window face 70 of the FIG. 3 handle riser. The displacement of the face 76 from the centerline R—R should ordinarily be no less than about ⅜ of an inch, more preferably at least about ½ inch and may be as much as a full inch.

Figure 5:
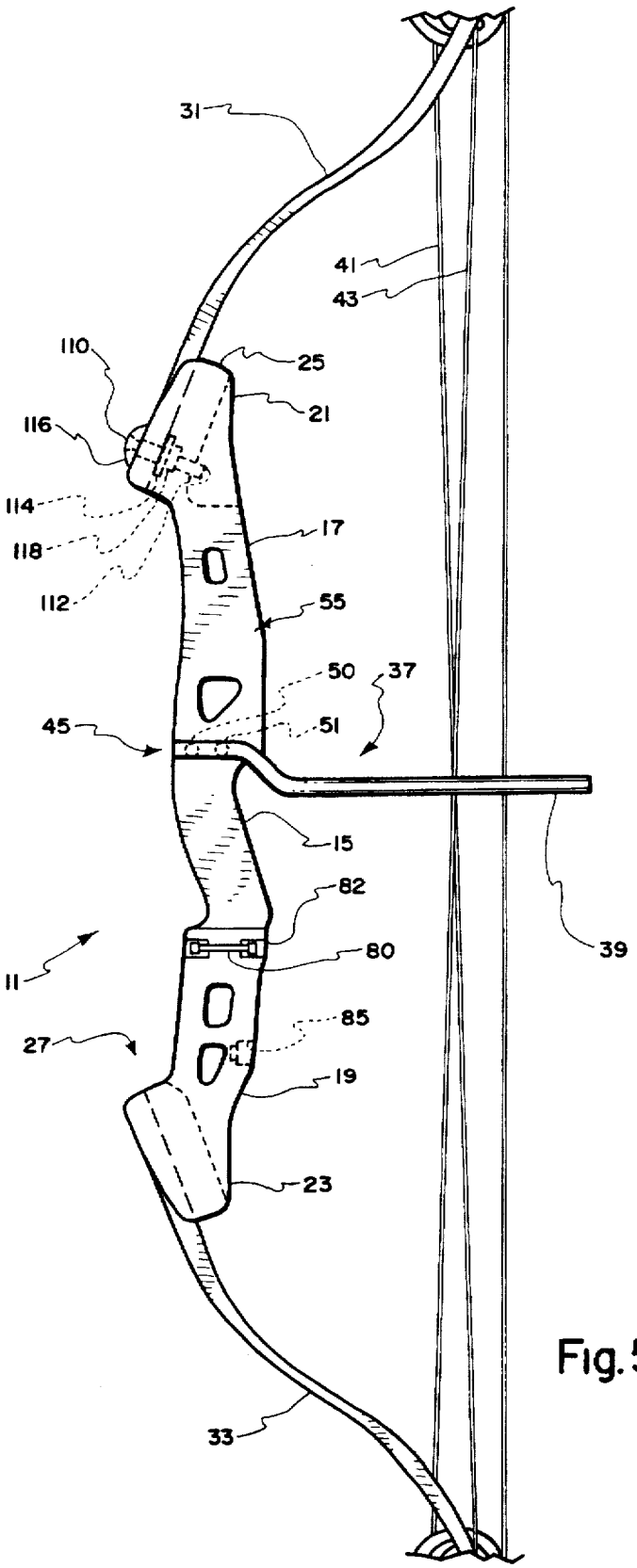
FIG. 5 is a view in side elevation of the bow of FIG. 1 in assembled condition, internal components being shown in phantom lines and the bow limbs being represented schematically.

As best shown by FIG. 5, a mercury-filled stabilizer 80 is mounted within a receptacle 82 internal the lower end portion 19 of the riser 11. An additional accessory mounting insert 85 is shown at a unique location approximately midway between the handle portion 15 and lower limb mounting surface 25. This insert 85 is particularly useful for the mounting of a rearwardly projecting accessory (not shown), such as a stabilizer, with a mass adequate to balance a forwardly extending stabilizer (not shown). Placing additional weight on the lower end of the handle riser inherently tends to level the bow during shooting.

Figure 6:
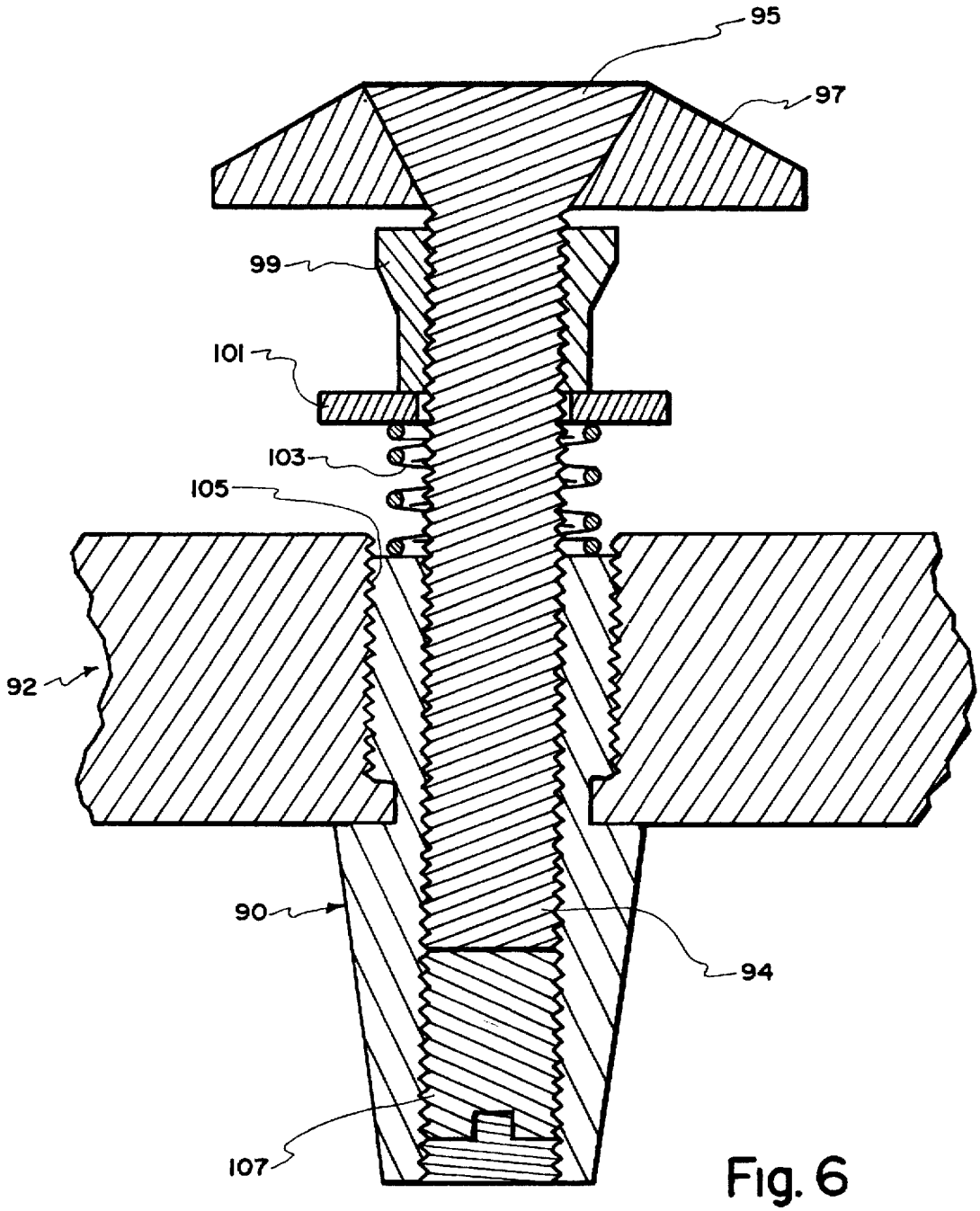
FIG. 6 is a cross-sectional view of a limb bolt assembly of this invention.

As illustrated by FIG. 6, a limb bolt assembly for a recurve take down bow includes a limb bolt insert 90 installed within a bore 91 in the limb pocket 92 of a riser. The threaded shaft 94 of a limb bolt 95 passes in turn through a washer 97, a limb retaining bushing 99, a flat washer 101 and spring 103, and is turned into internal threads 105 of the limb bolt insert 90. The bushing 99 seats in the butt end of a bow limb (not shown). The washer 101 functions as a wear and bearing surface between the limb and the spring 103. The weight of the limb is adjusted by turning the bolt 95 in the insert 90 to compress or release the spring 103. When the limb weight is properly adjusted, a set screw 107 may be turned into the internal threads 105 to jam against the end of threaded shaft 94.

FIG. 5 illustrates the limb bolt assembly currently favored for use with compound bows. A bolt 110 is threaded into a bore provided in the mounting surface 25. A limb 31 is clamped between a limb washer 114 and a limb grommet 116 by means of the jam nut 118. Adjustment of the nut 118 on the threaded shaft of the bolt 110 constitutes a suitable means for adjusting the rotational position of the limb 31 with respect to the surface 25.

Figure 8:
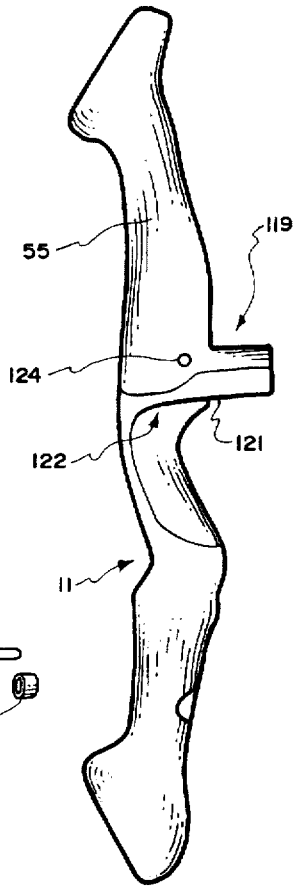
FIG. 8 is an elevational side view of the bow with an overdraw assembly.
Figure 7:
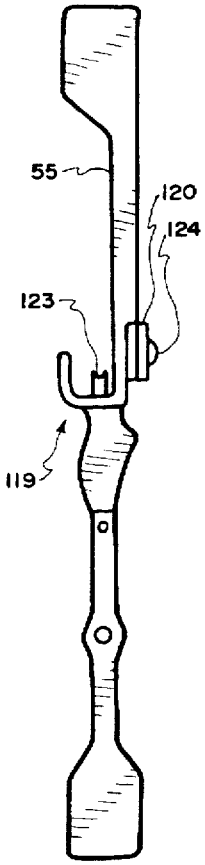
FIG. 7 is an elevational front view of a bow with an overdraw assembly.

FIGS. 7 and 8 illustrate an overdraw assembly 119 attached to the handle riser 11 to enable a full draw to be made with a short arrow. The overdraw assembly 119 extends to the rear of the handle riser 11, which permits the head of a short arrow to be drawn to a position to the rear of the handle riser. The handle riser 119 is a "U"-shaped member in cross-section wherein one side 120 of the member is attached to the handle riser 11. The forward portion 121 of the overdraw assembly extends rearward from the bow handle shelf 122 to create an extended shelf surface.

An arrow rest member 123 is attached to the overdraw assembly so that the arrow rest is positioned in a substantially central location (see FIG. 7) in the "U"-shaped opening of the overdraw assembly. The arrow rest is generally aligned with the drawstring.

Bolt member 124 attaches the overdraw assembly 119 to the bow riser 11.

Reference in this disclosure to specific details of the preferred embodiments is not intended to limit the scope of the appended claims, which themselves define the invention, including equivalents.

What is claimed:

1. In a handle riser for archery bows of the type which include means for mounting an overdraw arrow support device, said handle riser including a sight window including a sight face above a grip portion and displaced from a vertical central axis of said handle riser and said handle riser further including an accessory mounting face spaced from and above said grip portion and the space occupied by an overdraw arrow support device mounted to said handle riser, the improvement which comprises providing said sight face in the form of an approximately vertical planar surface spaced sufficiently from said central axis to provide clearance for the vanes of an arrow launched from an overdraw support device mounted to said handle riser, said sight face extending from approximately said grip portion to approximately adjacent said accessory mounting face.

2. An improvement according to claim 1, wherein said sight face is spaced from said vertical central axis by a distance of at least about ⅜ inch.

3. An improvement according to claim 2, wherein said sight face is spaced from said vertical central axis by a distance of at least about ½ inch.

4. An improvement according to claim 1 wherein said handle riser further includes a stabilizer device mounted internal said handle riser.

5. An improvement according to claim 4 wherein said stabilizer device is a mercury-filled stabilizer.

6. An improvement according to claim 4, further including an accessory mounting structure positioned beneath said grip to support a rearward projecting stabilizer.

7. An improvement according to claim 1, further including a cable guard structure including an arm positioned approximately along the horizontal central axis of said handle riser.

8. An archery bow, comprising:

a handle riser, comprising:

a grip portion;

a sight window directly above said grip portion on a first side of said riser, said sight window including a substantially planar sight face; and an accessory mounting face spaced from and above said grip portion on a second side of said riser opposite said first side; and a cable guard mounted beneath said mounting face and above said grip portion, said cable guard including an arm disposed approximately parallel and at approximately the same elevation as a horizontal central axis of said handle riser.

9. An archery bow according to claim 8, wherein said sight face is formed as an approximately vertical planar surface displaced from a vertical central axis of said handle riser sufficiently to provide clearance for the vanes of an arrow launched from an overdraw support device mounted to said handle riser, said sight face extending from approximately said grip portion to approximately adjacent said accessory mounting face.

10. An archery bow according to claim 9, wherein said sight face is spaced from said vertical central axis by a distance of at least about ⅜ inch.

11. An archery bow according to claim 10, wherein said sight face is spaced from said vertical central axis by a distance of at least about ½ inch.

12. An archery bow according to claim 8 wherein said handle riser further includes a stabilizer device mounted internal said handle riser.

13. An archery bow according to claim 12 wherein said stabilizer device is a mercury-filled stabilizer.

14. An archery bow according to claim 12, further including an accessory mounting structure positioned beneath said grip to support a rearward projecting stabilizer.

15. An archery bow, comprising:

a handle riser, comprising:

a grip portion;

a sight window directly above said grip portion on a first side of said riser, said sight window including a substantially planar sight face; and an accessory mounting face spaced from and above said grip portion on a second side of said riser opposite said first side; and a stabilizer device mounted internal said handle riser;

wherein said stabilizer device is a mercury-filled stabilizer.

16. An archery bow, comprising:

a handle riser, comprising:

a grip portion;

a sight window directly above said grip portion on a first side of said riser, said sight window including a substantially planar sight face; and an accessory mounting face spaced from and above said grip portion on a second side of said riser opposite said first side; and a stabilizer device mounted internal said handle riser;

wherein sight face is formed as an approximately vertical planar surface displaced from a vertical central axis of said handle riser sufficiently to provide clearance for the vanes of an arrow launched from an overdraw support device mounted to said handle riser, said sight face extending from approximately said grip portion to approximately adjacent said accessory mounting face.

17. An archery bow according to claim 16, wherein said sight face is spaced from said vertical central axis by a distance of at least about ⅜ inch.

18. An archery bow according to claim 17, wherein said sight face is spaced from said vertical central axis by a distance of at least about ½ inch.

* * * * *